US009901840B2

(12) United States Patent
Hollowell et al.

(10) Patent No.: US 9,901,840 B2
(45) Date of Patent: Feb. 27, 2018

(54) PLAYHOUSE ASSEMBLY

(71) Applicants: Mary Hollowell, Champlin, MN (US); Denise Blaede, Champlin, MN (US)

(72) Inventors: Mary Hollowell, Champlin, MN (US); Denise Blaede, Champlin, MN (US)

( * ) Notice: Subject to any disclaimer, the term of this patent is extended or adjusted under 35 U.S.C. 154(b) by 0 days.

(21) Appl. No.: 14/837,507

(22) Filed: Aug. 27, 2015

(65) Prior Publication Data

US 2016/0067624 A1 Mar. 10, 2016

Related U.S. Application Data

(60) Provisional application No. 62/047,858, filed on Sep. 9, 2014.

(51) Int. Cl.
*A63H 3/52* (2006.01)
*A63H 33/00* (2006.01)

(52) U.S. Cl.
CPC ..... *A63H 33/008* (2013.01)

(58) Field of Classification Search
CPC .. A63H 3/00; A63H 3/52; A63H 33/32; E04B 1/00; E04B 1/14; E04B 1/3211; E04H 9/16
USPC ..... 446/476–478, 113, 122; 52/80.1–80.2, 52/81.1–81.3
See application file for complete search history.

(56) References Cited

U.S. PATENT DOCUMENTS 2,879,553 A 5/1957 Keating
3,039,478 A 6/1962 Timmons
4,068,421 A * 1/1978 Marovich ..... A01G 9/1407 47/17
4,297,814 A * 11/1981 Tomassetti, Jr. ..... E04B 1/3211 52/81.4
4,655,013 A * 4/1987 Ritland ..... E04B 1/14 52/127.9
4,665,664 A 5/1987 Knight
4,848,046 A * 7/1989 Wallhead ..... E04H 9/16 52/81.4
5,485,701 A * 1/1996 Hecht ..... E04B 1/3211 446/476
5,715,854 A * 2/1998 Andrieux ..... E04H 15/001 135/94
5,881,515 A * 3/1999 George ..... A63H 33/044 403/294
5,916,097 A 6/1999 Markuten
(Continued)

*Primary Examiner* — Kien Nguyen
(74) *Attorney, Agent, or Firm* — Global Intellectual Property Agency, LLC; Daniel Enea

(57) ABSTRACT

A playhouse assembly for constructing a dome-shaped housing. The playhouse assembly includes one or more contoured upper wall elements that connect to one another to form an upper wall of a dome-shaped structure, resembling an igloo. A transparent dome-shaped window is secured to the top of the upper wall in order to form the peak of the dome-shaped structure. Each upper wall element includes one or more rods extending from a lower edge thereof, wherein the rods can be inserted into a lower wall formed by snow. In some embodiments of the playhouse assembly, one or more lower wall elements are included, wherein each of the lower wall elements connect to one another to form the lower wall of the structure, rather than using snow to form the lower wall thereof. Further, a ring-shaped template is provided in order to guide a user when constructing the lower wall.

14 Claims, 4 Drawing Sheets

(56) References Cited

U.S. PATENT DOCUMENTS

| | | | | |
|---|---|---|---|---|
| 6,283,819 | B1 * | 9/2001 | Polinger | A63H 3/52 446/478 |
| 6,331,147 | B1 * | 12/2001 | Munro | A63H 33/32 446/478 |
| 6,421,963 | B1 | 6/2002 | Pratola | |
| 7,458,186 | B2 | 12/2008 | Carter | |
| 2004/0065026 | A1 * | 4/2004 | Wilson | E04B 1/3211 52/80.1 |

* cited by examiner

PLAYHOUSE ASSEMBLY

CROSS REFERENCE TO RELATED APPLICATION

This application claims the benefit of U.S. Provisional Application No. 62/047,858 filed on Sep. 9, 2014. The above identified patent application is herein incorporated by reference in its entirety to provide continuity of disclosure.

BACKGROUND OF THE INVENTION

Field of the Invention

The present invention relates to building structures. More specifically, the present invention provides a playhouse assembly comprising one or more contoured upper wall elements connected to one another to form an upper wall of a dome-shaped structure, wherein snow is used to construct a lower wall thereof. The upper wall and lower wall connect to one another to define an enclosed area. A transparent window is disposed on the upper wall of the structure in order to form the peak thereof. In an alternate embodiment, a lower wall is provided comprising one or more lower wall elements connected to one another and to the upper wall, rather than using snow to construct a lower wall.

Many children and adults enjoy playing in the snow and constructing playhouses, such as forts and igloos. However, it is difficult to construct a dome shaped roof of an igloo in a way that ensures the roof will not collapse. If the roof collapses while a person is inside of the igloo or fort, the individual may be injured or stuck underneath the heavy snow. Furthermore, constructing a fort or igloo is difficult and time consuming. Children spend the majority of their play time constructing the playhouse rather than using their creativity and imagination playing therein. Therefore, there exists a need in the prior art for a device that helps users to efficiently construct a safe fort or igloo.

Devices have been disclosed in the prior art that relate to building structures. These include devices that have been patented and published in patent application publications. These devices generally relate to structures having a dome shaped housing or frame, such as U.S. Pat. No. 2,879,553, U.S. Pat. No. 7,458,186, U.S. Pat. No. 4,665,664, U.S. Pat. No. 5,916,097, U.S. Pat. No. 6,421,963, and U.S. Pat. No. 3,039,473.

These prior art devices have several known drawbacks. The prior art devices include a dome shaped enclosure having an entranceway. Some of the devices are formed using a plurality of panels and comprise windows along a wall thereof. However, the devices in the prior art fail to provide a lower wall and an upper wall, wherein the upper wall comprises one or more rods adapted to be disposed through the lower walls. Furthermore, the devices fail to provide a transparent window forming the uppermost portion of the present invention.

In light of the devices disclosed in the prior art, it is submitted that the present invention substantially diverges in design elements from the prior art and consequently it is clear that there is a need in the art for an improvement to existing playhouse assemblies. In this regard the instant invention substantially fulfills these needs.

SUMMARY OF THE INVENTION

In view of the foregoing disadvantages inherent in the known types of playhouse assemblies now present in the prior art, the present invention provides a new playhouse assembly wherein the same can be utilized for providing convenience for the user when constructing a dome-shaped structure.

It is therefore an object of the present invention to provide a new and improved playhouse assembly that has all of the advantages of the prior art and none of the disadvantages.

It is another object of the present invention to provide a playhouse assembly comprising one or more contoured upper wall elements having lateral edges that connect to one another to form an upper wall of a dome-shaped structure, wherein each upper wall element includes an upper edge, a lower edge, and one or more sidewalls.

Another object of the present invention is to provide a playhouse assembly comprising a dome-shaped transparent window secured to the upper edge of each of the contoured upper wall elements in order to form the peak of the dome-shaped structure.

Another object of the present invention is to provide a playhouse assembly comprising one or more rods extending from the lower edge of each of the contoured upper wall elements, wherein the rods are adapted to be inserted into a lower wall formed by snow.

Yet another object of the present invention is to provide a playhouse assembly wherein, in alternate embodiments, one or more lower wall elements are included, wherein each of the lower wall elements connect to one another to form the lower wall of the structure, rather than using snow to form the lower wall thereof.

Yet another object of the present invention is to provide a playhouse assembly further comprising a ring-shaped template adapted to be disposed on a horizontal support surface so as to guide a user in the construction and placement of the lower wall.

Another object of the present invention is to provide a playhouse assembly that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
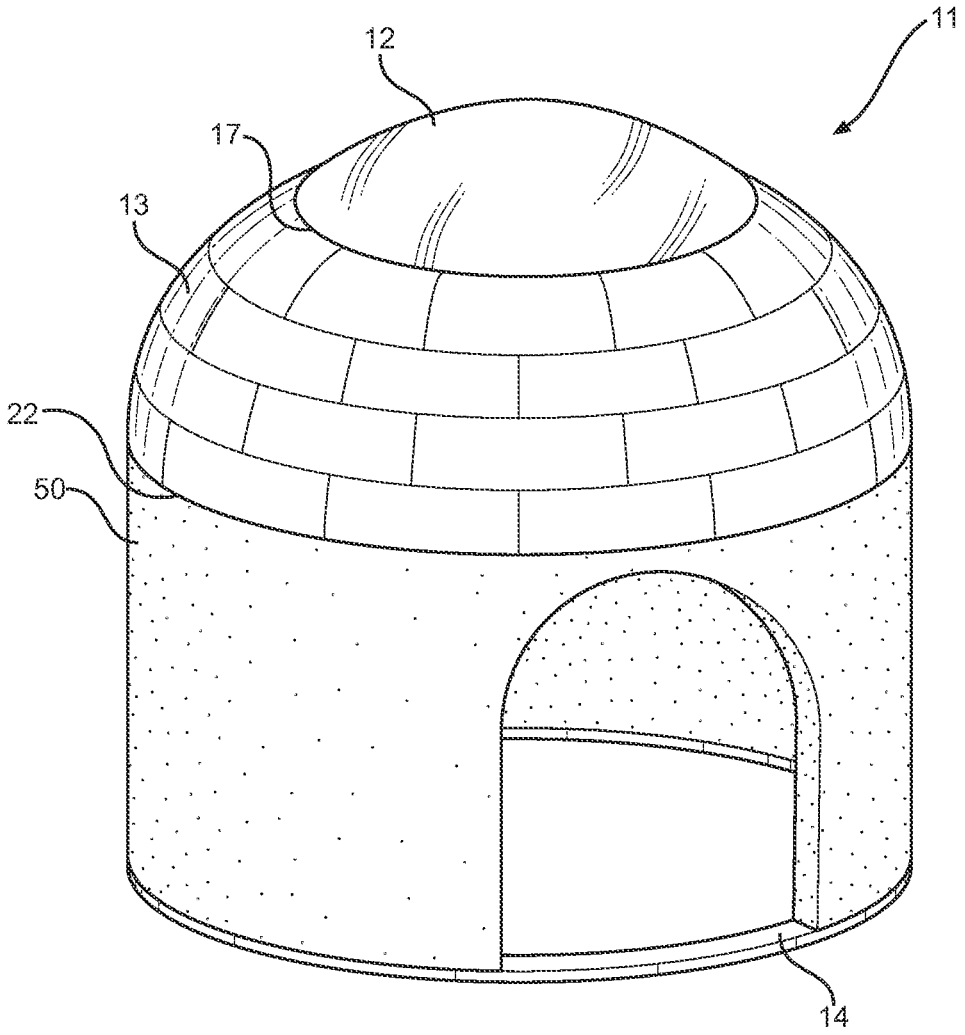
FIG. 1 shows a perspective view of an embodiment of the playhouse assembly.

Reference is made herein to the attached drawings. Like reference numerals are used throughout the drawings to depict like or similar elements of the playhouse assembly. For the purposes of presenting a brief and clear description of the present invention, the preferred embodiment will be discussed as used for constructing a dome-shaped structure. The figures are intended for representative purposes only and should not be considered to be limiting in any respect.

Figure 2:
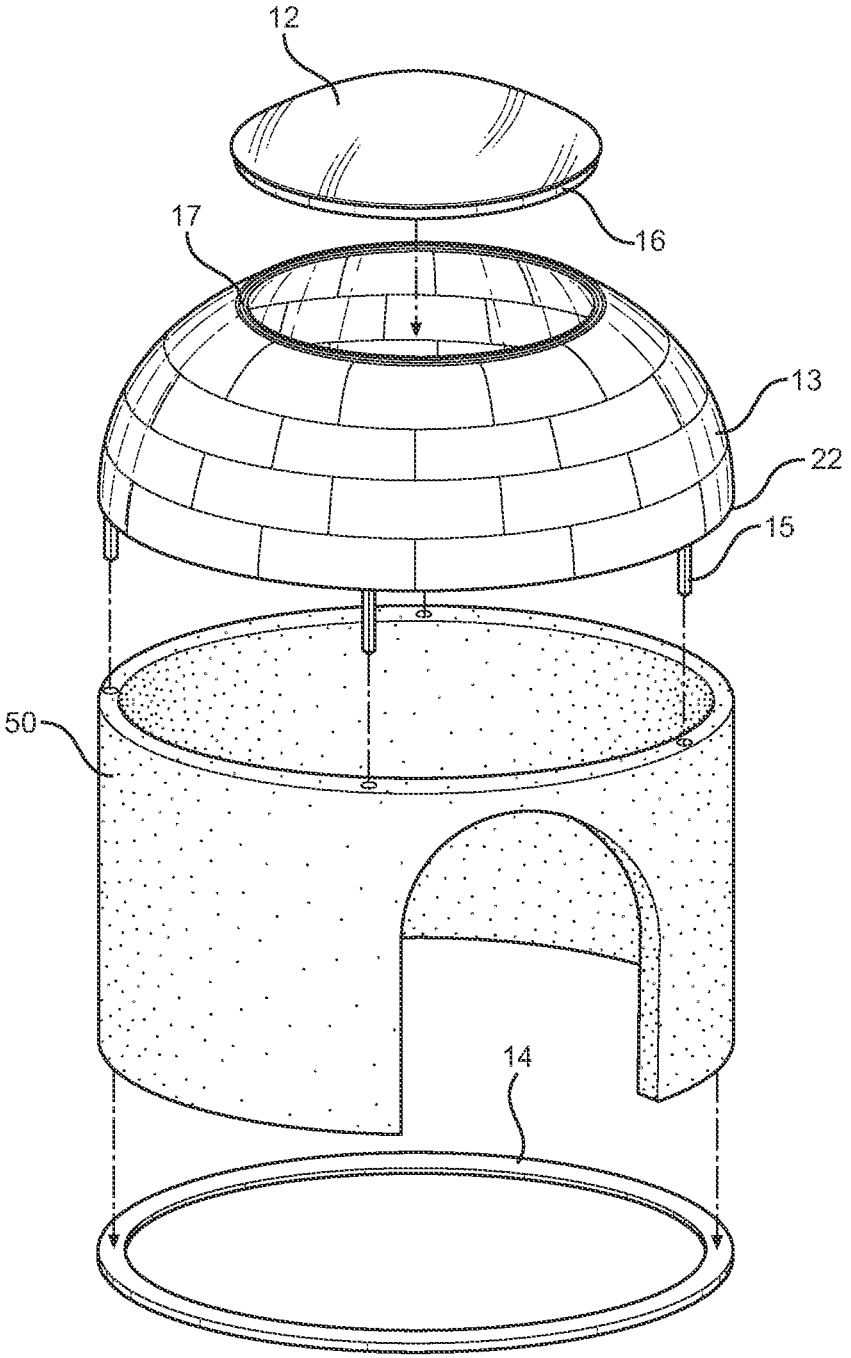
FIG. 2 shows an exploded view of an embodiment of the playhouse assembly.

Referring now to FIGS. 1 and 2, there is shown a perspective view of an embodiment of the playhouse assembly and an exploded view of an embodiment of the playhouse assembly, respectively. The playhouse assembly 11 includes an upper wall 13 comprising one or more upper wall elements (as referenced in FIG. 3, 21), wherein each of the upper wall elements connect to one another to form a loop configuration. The upper and lower ends of the upper wall 13 are open so as to provide a user access to above and below the interior of the upper wall 13. Each upper wall element comprises an upper edge 17, a lower edge 22, and opposing lateral edges. A first lateral edge of a first upper wall element is connected to a second lateral edge of a second upper wall element (as referenced in FIG. 3, 32, 33). Preferably, the upper wall 13 is contoured and the cross section thereof comprises a circular shape so as to allow for a dome-shaped structure.

The playhouse assembly 11 further comprises a transparent window 12 disposed on the upper edge 17 of the upper wall 13 so as to allow a user to view outside of the playhouse assembly 11 through the peak thereof. In the illustrated embodiment, the window 12 is dome-shaped and comprises a lower edge 16 having a lip disposed therearound that rests securely on the upper edge 17 of the upper wall 13. In the illustrated embodiment, the upper edge 17 of the upper wall 13 comprises a channel that receives the lip, however, in alternate embodiments, the window 12 may attach to the upper wall 13 by any suitable means, including edges that rest flush on one another.

The upper wall 13 further comprises one or more rods 15 extending from the lower edge 22 thereof. The rods 15 are adapted to be positioned into a lower wall 50 constructed from snow, wherein the walls 13, 50 are used to define an enclosed area. Preferably, the rods 15 extend vertically downwards so as to penetrate an upper end of a wall 50 of snow. In some embodiments, the lower end of each rod 15 is pointed so as to more easily penetrate the snow. The rods 15 are preferably spaced at a fixed distance from one another.

In some embodiments, the playhouse assembly 11 further comprises a template 14 having a first side and a second side, wherein the second side is planar and adapted to rest flush against a horizontal support surface, such as the ground. The template 14 provides a guide to the user when constructing the lower wall 50 from snow. Preferably, the template 14 is disposed in a loop configuration, wherein the width of the template 14 is adapted to indicate to the user the necessary width of the lower wall 50 needed in order to properly receive and secure to the upper wall 13. In this way, a user may initiate building the lower wall 50 on the first side of the template 14. Preferably, the template 14 comprises a circular cross section and the same diameter as the lower edge 22 of the upper wall 13 so as to allow a user to build a lower wall 50 having vertical sidewalls. In some embodiments, the first side of the template 14 includes raised lateral edges, forming a channel therebetween so as to further assist a user in construction of the lower wall 50.

In operation, a user positions the template 14 on the ground. A lower wall 50 composed of snow is built on the first side of the template 14. An opening may be included within the lower wall 50 composed of snow so as to allow a user to enter and exit the structure. The rods 15 extending from the upper wall 13 are positioned within the upper edge of the snow. The transparent window 12 is then positioned on the upper edge 17 of the upper wall 13, thereby forming an igloo-like playhouse. Alternatively, the lower wall 18 is provided for by one or more lower wall elements. The lower wall forms a loop configuration, wherein one or more apertures are positioned on the upper edge of the lower wall to receive the rods 15 extending from the upper wall 13. Thus, the upper and lower walls 13 are used to define an enclosed area.

Figure 3:
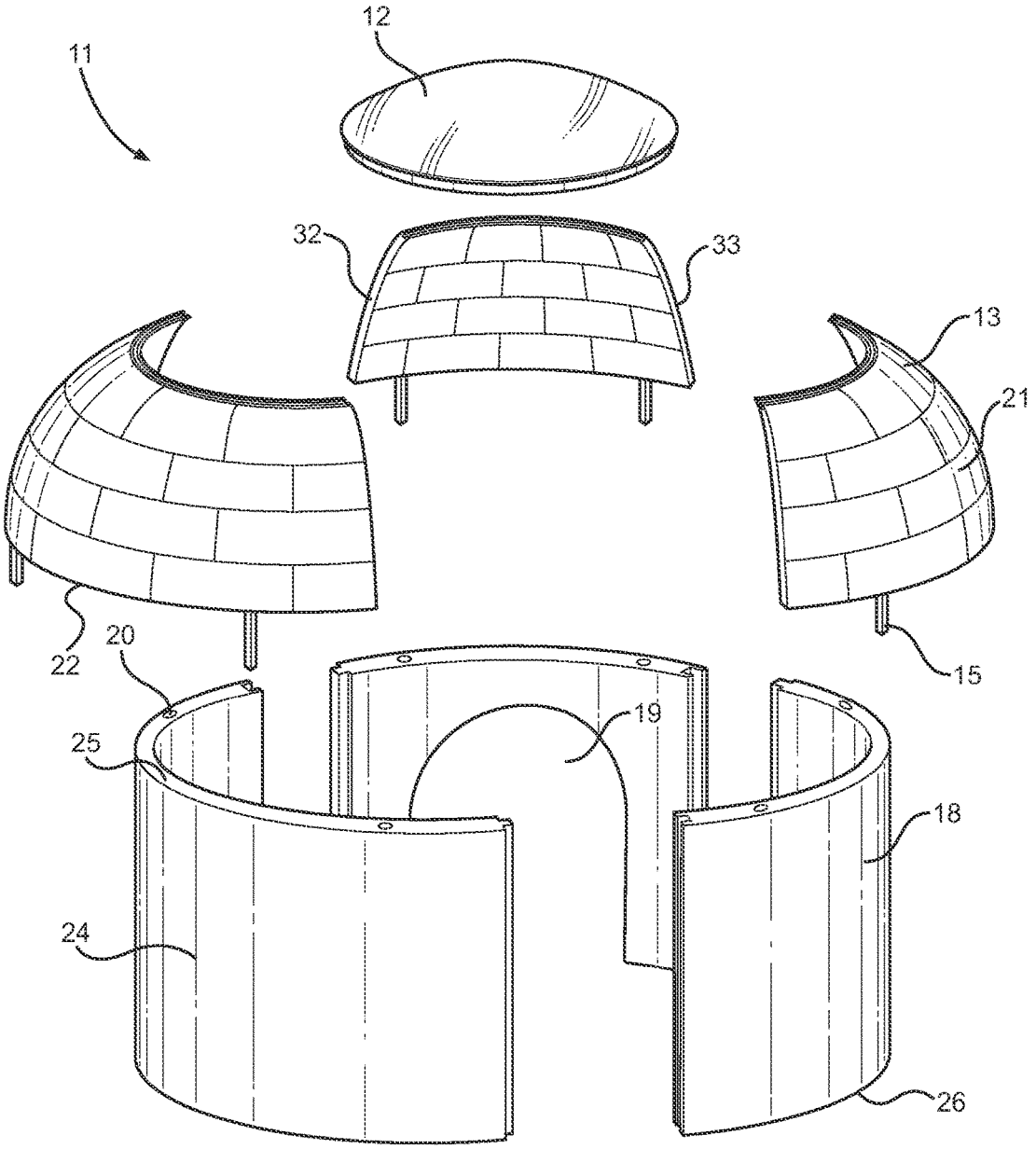
FIG. 3 shows an exploded view of an alternate embodiment of the playhouse assembly.

Referring now to FIG. 3, there is shown an exploded view of an alternate embodiment of the playhouse assembly. In some embodiments, the playhouse assembly 11 includes a lower wall 18 comprising one or more lower wall elements 24, wherein each of the lower wall elements 24 connect to one another to form a loop configuration, rather than using snow to form the lower wall thereof. The lower wall 18 comprises an open upper end so as to allow a user access to the interior of the upper wall 13 and transparent window 12. Each lower wall element 24 comprises an upper edge 25 and a lower edge 26. Preferably, the lower wall 18 comprises a circular cross section so as to allow align with the dome-shaped upper wall 13. At least one lower wall elements 24 comprise an opening 19 adapted to provide a doorway to enter the playhouse assembly 11. In the illustrated embodiment, the opening 19 comprises a U-shape, however, in alternate embodiments the opening 19 can comprise any suitable shape, such as a rectangular or irregular shape.

The upper edge 25 of each of the lower wall elements 24 comprise one or more apertures 20 that are aligned with and receive one of the rods 15 extending from the upper wall 13. The apertures 20 and the rods 15 preferably comprise the same diameter so the rods 15 fit securely within the apertures 20. Thus the upper wall elements 21 fit securely to the lower wall elements 24. The lower edge 22 of the upper wall 13 preferably comprises the same diameter as the upper edge 25 of the lower wall 18 in order for the wall of the playhouse assembly 11 to have a flush and seamless exterior appearance. In the illustrated embodiment, three lower wall elements 24 form the lower wall 18, wherein each element 24 comprises a pair of apertures 20 that receive corresponding rods 15 disposed on three corresponding upper wall elements 21.

Figure 4:
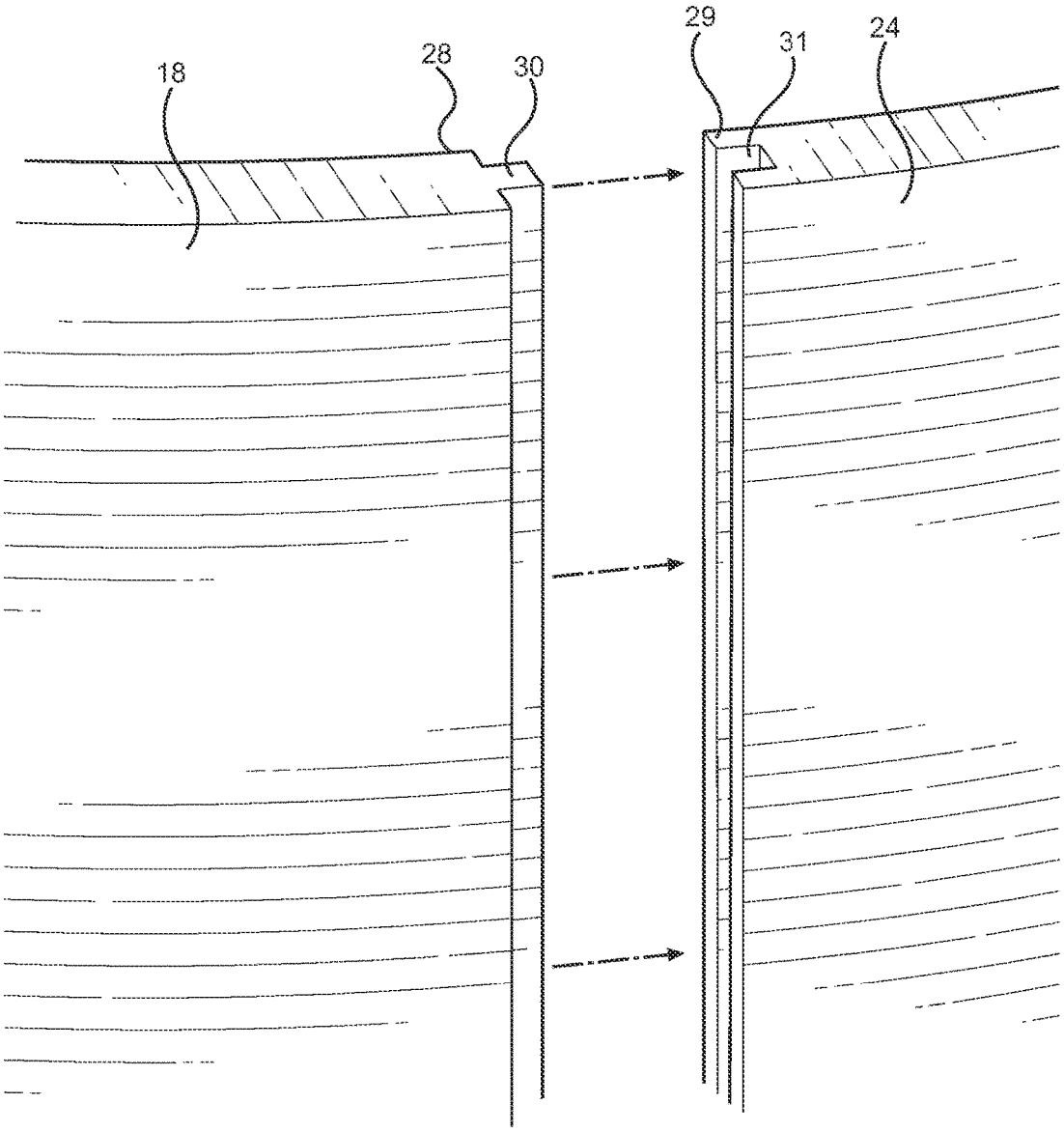
FIG. 4 shows a perspective view of an interlocking joint of the playhouse assembly.

Referring now to FIG. 4, there is shown a perspective view of an interlocking mechanism of the playhouse assembly. In some embodiments, each of the lower wall elements 24 comprise a first lateral edge 28 and a second lateral edge 29, wherein a first lateral edge 28 of a first lower wall element 24 connects to a second lateral edge 29 of a second lower wall element 24 via an interlocking mechanism. Preferably, the interlocking mechanism comprises one or more protrusions 30 extending from the first lateral edge 28 disposed in one or more channels 31 disposed on the second lateral edge 29. However, in alternate embodiments, other interlocking mechanism can be used to secure the elements 24 to one another. In some embodiments, one or more fasteners are disposed along the lateral edges 28, 29 that connect the elements 24 to one another, such as a latch mechanism.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A playhouse assembly, comprising:

an upper wall comprising one or more upper wall elements, wherein said one or more upper wall elements comprise a lower edge, an upper edge, a first lateral edge, and a second lateral edge;

wherein said upper wall forms an enclosed area;

a transparent window comprising a lower edge, wherein said lower edge of said transparent window is connected to said upper edge of each of said one or more upper wall elements;

wherein said transparent window is disposed at a peak of said upper wall;

one or more rods extending downwards from said lower edge of each of said one or more upper wall elements, wherein said one or more rods are completely disposed within a lower wall when affixed thereto, in order to secure said one or more upper wall elements to the lower wall;

wherein said upper edge of each of said one or more upper wall elements comprise a channel thereon and said lower edge of said transparent window comprises a lip therearound, wherein said channel is configured to receive said lip therein.

2. The playhouse assembly of claim 1, wherein said one or more upper wall elements comprise at least two upper wall elements, wherein said first lateral edge of a first upper wall element is connected to said second lateral edge of a second upper wall element to form said upper wall of said enclosed area.

3. The playhouse assembly of claim 1, further comprising a template having a first side and a second side, wherein said template is disposed in a loop formation and said first side is adapted to receive a lower wall thereon.

4. The playhouse assembly of claim 1, further comprising a lower wall having one or more lower wall elements, wherein each of said one or more lower wall elements comprise a lower edge, an upper edge, a first lateral edge, and a second lateral edge, such that said lower wall forms an enclosed area.

5. The playhouse assembly of claim 4, wherein said one or more lower wall elements comprise at least two lower wall elements, wherein said first lateral edge of a first lower wall element is connected to said second lateral edge of a second lower wall element to form a lower wall of said enclosed area.

6. The playhouse assembly of claim 5, wherein said first lateral edge of said first lower wall element comprises one or more protrusions and said second lateral edge of said second lower wall element comprises one or more channels, such that said one or more protrusions are disposed within said one or more channels in order to lock said first lower wall element to said second lower wall element.

7. The playhouse assembly of claim 4, wherein each of said one or more lower wall elements comprise one or more apertures disposed on said upper edge thereof and said one or more upper wall elements each comprise said one or more rods extending downwards therefrom, such that said one or more rods are aligned with and are disposed in said one or more apertures in order to secure said upper wall to said lower wall.

8. The playhouse assembly of claim 4, wherein said lower wall comprises a circular cross section in order to align with said upper wall.

9. The playhouse assembly of claim 1, wherein said one or more upper wall elements are contoured to form a dome-like structure.

10. The playhouse assembly of claim 1, wherein said upper wall comprises a circular cross section.

11. The playhouse assembly of claim 1, wherein said transparent window comprises a dome-shape.

12. The playhouse assembly of claim 1, wherein said transparent window is removably secured to said peak of said upper wall.

13. The playhouse assembly of claim 1, wherein said transparent window is configured to allow a user disposed within said enclosed area of said upper wall to view through said transparent window.

14. The playhouse assembly of claim 1, wherein a lower end of said one or more rods are pointed.

* * * * *